US011911663B2

(12) United States Patent
Chang et al.

(10) Patent No.: US 11,911,663 B2
(45) Date of Patent: Feb. 27, 2024

(54) TRAINING DEVICE AND TRAINING METHOD FOR REDUCING HYPERTONIC

(71) Applicant: Chang Gung University, Taoyuan (TW)

(72) Inventors: Ya-Ju Chang, Taoyuan (TW); Hsiao-Lung Chan, Taoyuan (TW); Jiunn-Woei Liaw, Taoyuan (TW); Cheng-Chung Kuo, Taoyuan (TW)

(73) Assignee: CHANG GUNG UNIVERSITY, Taoyuan (TW)

( * ) Notice: Subject to any disclaimer, the term of this patent is extended or adjusted under 35 U.S.C. 154(b) by 129 days.

(21) Appl. No.: 17/701,757

(22) Filed: Mar. 23, 2022

(65) Prior Publication Data

US 2023/0053908 A1 Feb. 23, 2023

(30) Foreign Application Priority Data

Aug. 23, 2021 (TW) ..... 110131003

(51) Int. Cl.
*A63B 24/00* (2006.01)
*A63B 21/005* (2006.01)
*A63B 22/00* (2006.01)

(52) U.S. Cl.
CPC ..... *A63B 24/0087* (2013.01); *A63B 21/0058* (2013.01); *A63B 22/0056* (2013.01); *A63B 2024/0093* (2013.01); *A63B 2220/16* (2013.01); *A63B 2220/34* (2013.01); *A63B 2220/56* (2013.01); *A63B 2230/208* (2013.01)

(58) Field of Classification Search
CPC ..... A63B 24/0087; A63B 21/0058; A63B 22/0056; A63B 2024/0093; A63B 2220/16; A63B 2220/34; A63B 2220/56; A63B 2230/208; A63B 22/0694; A63B 71/0622; A63B 2220/51; A63B 2220/62; A63B 2220/833; A63B 2225/20; A63B 2225/50; A63B 21/225
See application file for complete search history.

(56) References Cited

U.S. PATENT DOCUMENTS 3,540,436 A * 11/1970 Hueftle, Jr. ..... A61H 1/0262 601/35
6,572,514 B1 * 6/2003 Calafato ..... A63B 22/16 482/79

(Continued)

FOREIGN PATENT DOCUMENTS

CN 208160930 U 11/2018
CN 210751086 U 6/2020

(Continued)

*Primary Examiner* — Andrew S Lo
*Assistant Examiner* — Andrew M Kobylarz
(74) *Attorney, Agent, or Firm* — McClure, Qualey & Rodack, LLP

(57) ABSTRACT

A training device and a training method for reducing hypertonic are disclosed. The training device includes a base, a driving circuit, two pedals, a control circuit, and a switch circuit. The driving circuit is fixed on the base. Each of the two pedals is coupled to the base. The driving circuit drives each of the two pedals to swing repeatedly between a first position and a second position relative to the base. When the control circuit executes a training program, the control circuit actuates the driving circuit.

16 Claims, 9 Drawing Sheets

(56) References Cited

U.S. PATENT DOCUMENTS

| | | | | |
|---|---|---|---|---|
| 7,354,406 | B2 * | 4/2008 | Kim | A61H 1/003 601/100 |
| 10,569,124 | B2 * | 2/2020 | Dalmia | A63B 22/0664 |
| 2011/0021957 | A1 * | 1/2011 | Shinomiya | A61H 1/0262 601/5 |

FOREIGN PATENT DOCUMENTS

| | | | | | |
|---|---|---|---|---|---|
| CN | 212548128 | U | | 2/2021 | |
| CN | 213698709 | U | | 7/2021 | |
| CN | 216295116 | U | | 4/2022 | |
| JP | 2008061964 | A | * | 9/2006 | A63B 24/00 |

* cited by examiner

TRAINING DEVICE AND TRAINING METHOD FOR REDUCING HYPERTONIC

CROSS-REFERENCE TO RELATED PATENT APPLICATION

This application claims the benefit of priority to Taiwan Patent Application No. 110131003, filed on Aug. 23, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a training device and a training method, and more particularly to a training device and a training method for reducing hypertonic of a user.

BACKGROUND OF THE DISCLOSURE

Spasticity is a common symptom in patients with central nervous system damage, and the symptom often accompanies the patients throughout their lives. According to preliminary estimates from relevant medical institutions, more than 12 million people worldwide suffer from the symptom. One of the common treatment methods at present is employment of stretching device to apply prolonged stretch to reduce hypertonic to a certain degree in the patients' muscles. However, the prolonged stretch of muscles near its limit is likely to cause discomfort (e.g., pain, muscle strain, etc.) or pressure sores at pressure points.

SUMMARY OF THE DISCLOSURE

In response to the above-referenced technical inadequacy which results in user discomfort, the present disclosure provides a training device for reducing hypertonic.

In one aspect, the present disclosure provides a training device for reducing hypertonic. The training device includes a base, a driving circuit, two pedals, and a control circuit. The driving circuit is fixed on the base. Each of the two pedals is coupled to the base, and one of the two ends of each of the two pedals is configured to swing relative to the base with a rotation axis as its rotation center. Each of the two pedals has a placement area configured to allow feet soles of a user to be placed thereon. The two pedals are coupled to the driving circuit that is configured to drive each of the two pedals to swing repeatedly between a first position and a second position relative to the base. The control circuit is electrically coupled to the driving circuit. The control circuit is configured to store and execute at least one training program. When the control circuit executes the at least one training program, the control circuit actuates the driving circuit according to at least one training program so that the two pedals are driven to swing. The t least one training program includes the number of swings and, the speed of swings.

In another aspect, the present disclosure provides a training method for using a training device that comprises a control circuit, a driving circuit, and two pedals. The training method comprise: receiving at least one training program by the control circuit; and performing the at least one training program by the control circuit, so as to control the driving circuit to actuate the two pedals that are driven to swing; wherein the at least one training program comprises a number of swings and a swing speed.

Therefore, compared with the conventional stretching equipment, the training device provided by the present disclosure can greatly reduce the probability of causing pain to patients during or after use. Moreover, the training device provided by the present disclosure can improve muscle strength, reduce hypertonic, and improve anti-spasticity ability of the patients' muscle whereby effectively reduce the degree and frequency of spasticity onset in the patients.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
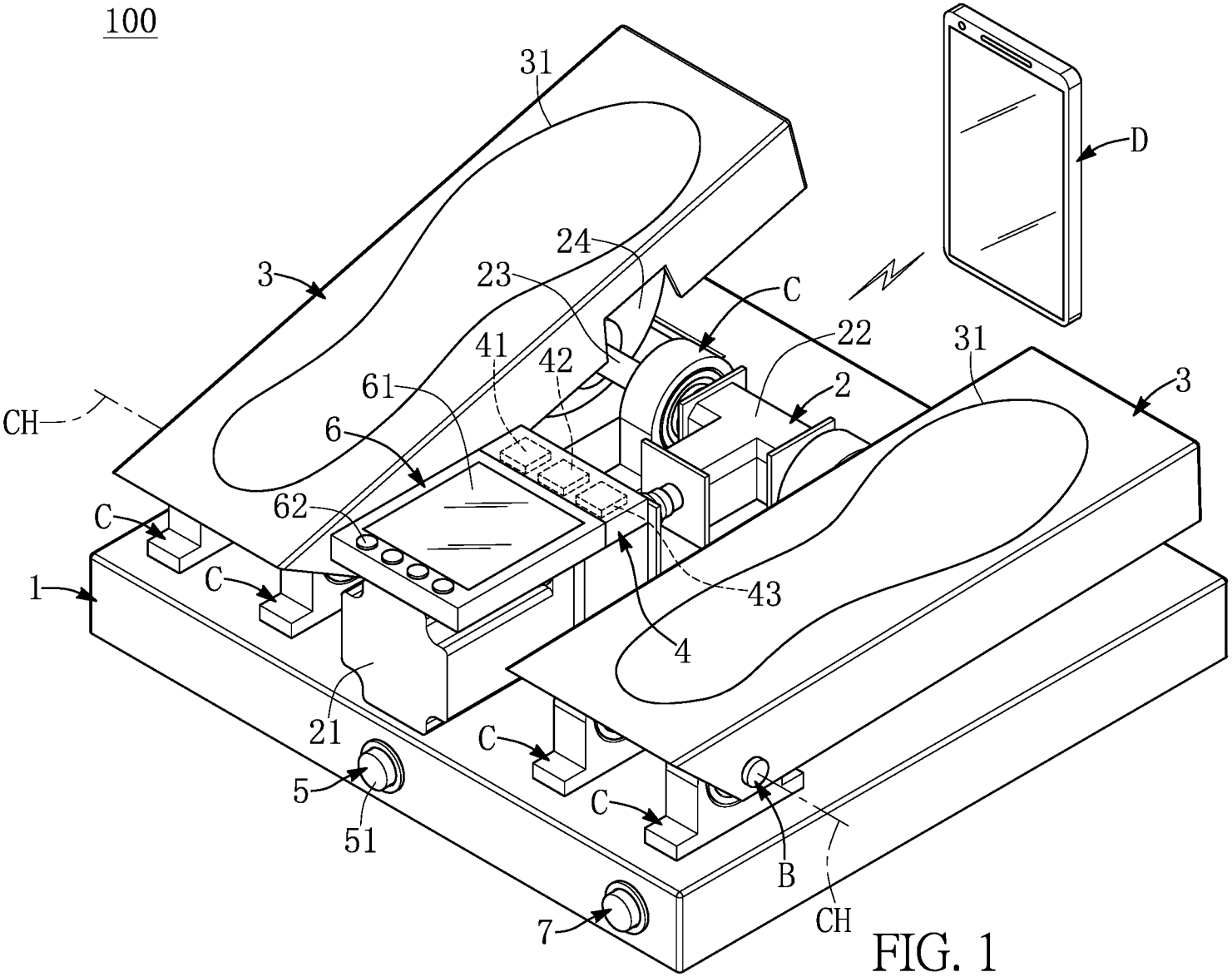
FIG. 1 is a schematic perspective view of a training device according to the present disclosure.
Figure 2:
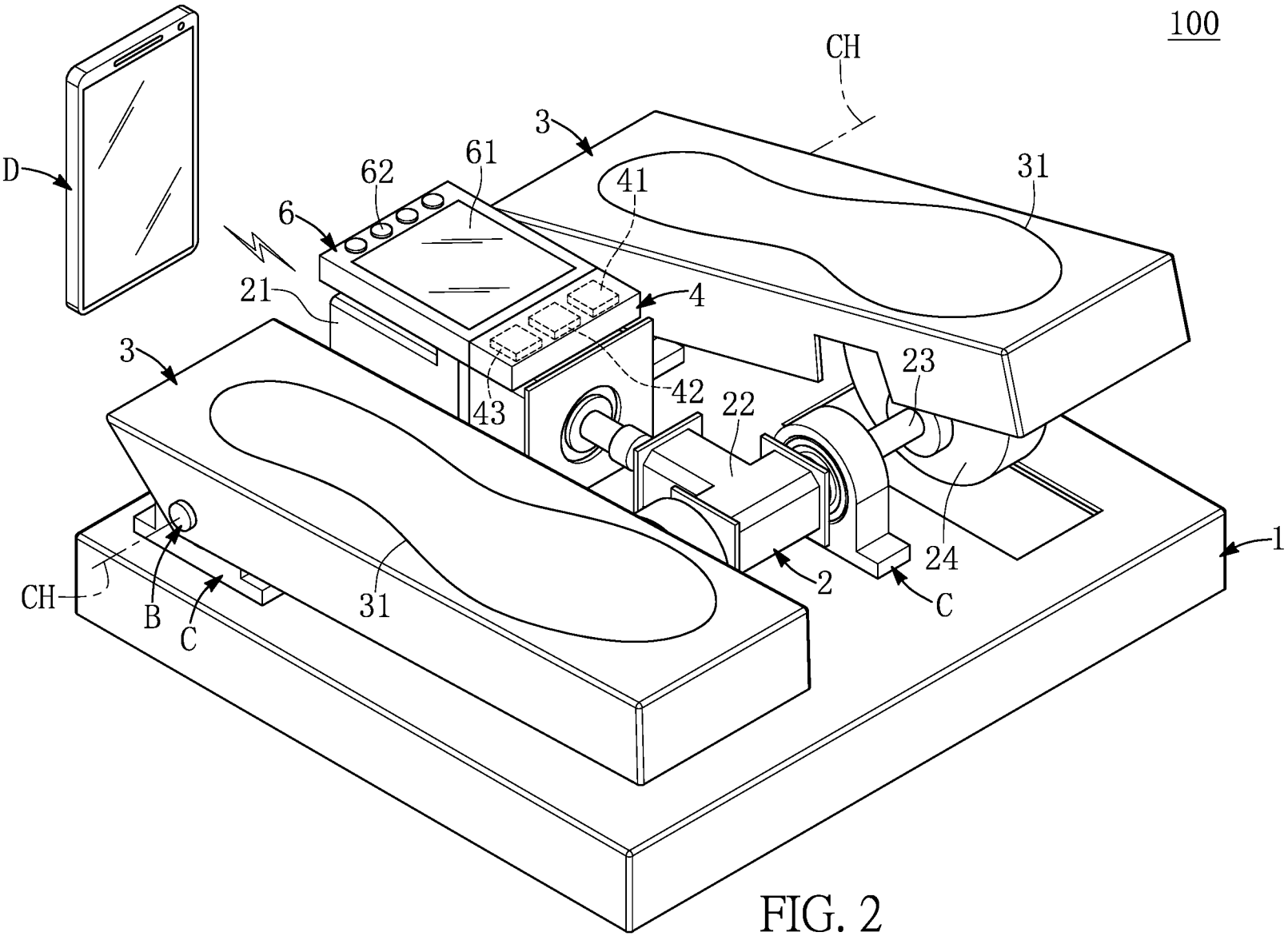
FIG. 2 is another schematic perspective view of the training device according to the present disclosure.
Figure 3:
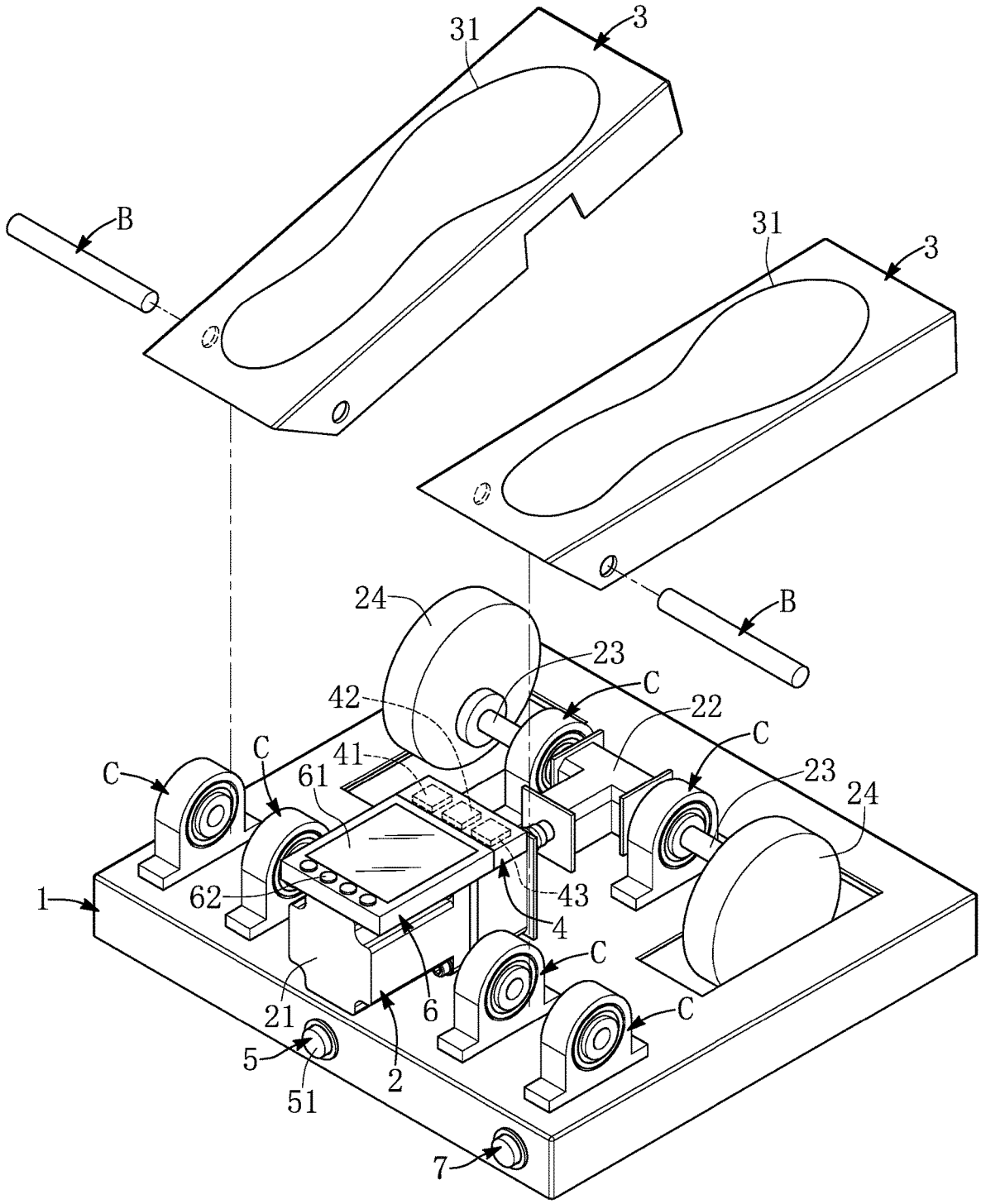
FIG. 3 is a schematic partial exploded view of the training device according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 5, the present disclosure provides a training device 100 for reducing hypertonic, and the training device 100 includes a base 1, a driving circuit 2, two pedals 3, a control circuit 4, and a switch circuit 5. The driving circuit 2 is fixed on the base 1, each of the two pedals 3 is coupled to the base 1, and one of the two ends of each of the two pedals 3 is configured to swing relatively to base 1 with a rotation axis A as a center. Each of the two pedals 3 may be pivotally coupled to the base 1 through a shaft B and a bearing assembly C, but the manner that the two pedals 3 are pivotally coupled to the base 1 is not limited to the figures.

Each of the two pedals 3 has a placement area 31 configured to provide a user to place soles of feet thereon. The two pedals 3 are coupled to the driving circuit 2 that is configured to drive each of the two pedals 3 to swing repeatedly between a first position and a second position relative to the base 1. The size and appearance of each of the two pedals 3, and the size and appearance of the placement area 31 can be adjusted according to practical requirements, and those illustrated in the figures of the present embodiment show only one of the exemplary aspects.

Specifically, the driving circuit 2 in one of the practical applications includes a motor 21, an adapter mechanism 22, two connecting rods 23, and two linkage wheels 24. The motor 21 is coupled to the adapter mechanism 22. The two connecting rods 23 are coupled to the adapter mechanism 22. One end of each of the two connecting rods 23 is coupled to one of the two linkage wheels 24, and each of the two linkage wheels 24 abuts against one of the two pedals 3.

The control circuit 4 is configured to actuate the motor 21, and the two connecting rods 23 are driven to rotate, through the adapter mechanism 22, by rotation of the motor 21 so as to drive synchronous rotation of the two linkage wheels 24. Each of the two linkage wheels 24 is configured to drive one of the two pedals 3 abutting thereagainst to swing relatively to the base 1 during the rotation.

In the drawings of the present embodiment, each of the two linkage wheels 24 is exemplified as an eccentric cam, but the form of the two linkage wheels 24 are not limited thereto. For example, each of the two linkage wheels 24 may also be a plate cam. A position where each of the two linkage wheels 24 abuts against one of the two pedals 3 is roughly opposite to one end of each of the two pedals 3 pivotally coupled to the base 1. The form and size of the two linkage wheels 24 can be adjusted according to practical requirements, the present embodiment is not limited thereto. In other words, a swinging amplitude (i.e., a swing angle) of each of the two pedals 3 is related to the form and size of the two linkage wheels 24, and can be adjusted according to practical requirements. In practical applications, for example, the motor 21 can be controlled to drive the two linkage wheels 24 to act so as to adjust an initial inclination (i.e., an initial angle) of each of the two pedals 3. In order to make each of the two connecting rods 23 rotate stably, the driving circuit 2 may also include two bearing assemblies C that are coupled to the two connecting rods 23, respectively.

The control circuit 4 is electrically coupled to the driving circuit 2 and is configured to store and execute at least one training program. When the control circuit 4 executes the at least one training program, the control circuit 4 controls the driving circuit 2 to actuate, so that each of the two pedals 3 swing at least 1 to 120 times per minute in a training cycle, and a swing angle of each of the two pedals 3 between the first position and the second position is 5 to 70 degrees.

Figure 4:
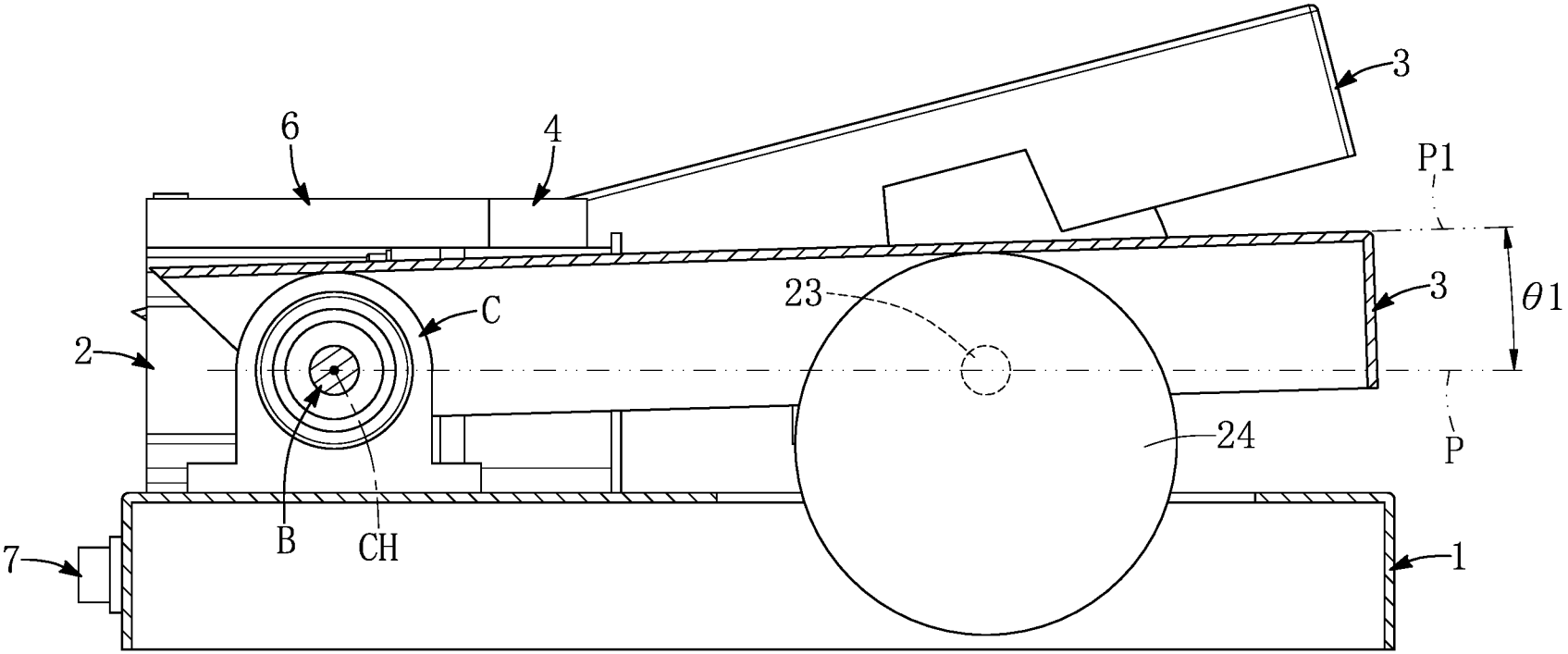
FIG. 4 and FIG. 5 are schematic partial cross-sectional views of two pedals of the training device located in a first position and a second position, respectively, according to the present disclosure.
Figure 5:
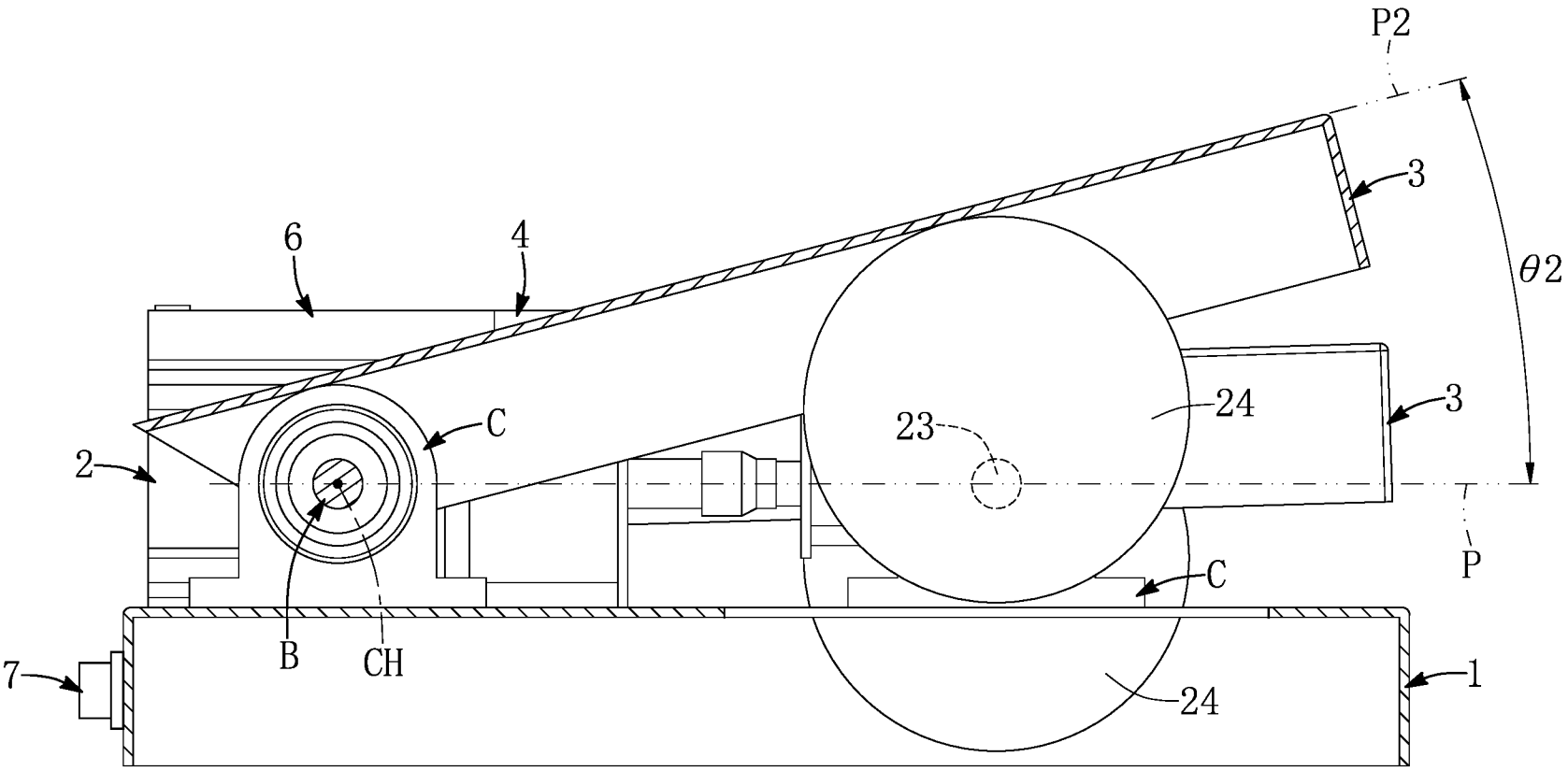

Referring to FIG. 4, when the two pedals 3 are located at the first position, an angle between a plane P1 in the placement area 31 of each of the two pedals 3 and a horizontal plane P is defined as a first angle θ1. When the first position is a lowest position, the first angle θ1 is the initial angle. Referring to FIG. 5, when the two pedals 3 are located at the second position, an angle between a plane P2 in the placement area 31 of each of the two pedals 3 and the horizontal plane P is defined as a second angle θ2. The first angle θ1 is less than the second angle θ2, and an angle difference between the second angle θ2 and the first angle θ1 is a swinging range within which each of the two pedals 3 can swing. The first angle θ1 and the second angle θ2 are related to the shape and size of the two linkage wheels 24. The first angle θ1 is within a range from −5 to 5 degrees, and the second angle θ2 is within a range from 5 to 70 degrees. In practical applications, the first angle θ1 and the second angle θ2 can be adjusted by changing the shape and size of the two linkage wheels 24.

Figure 6:
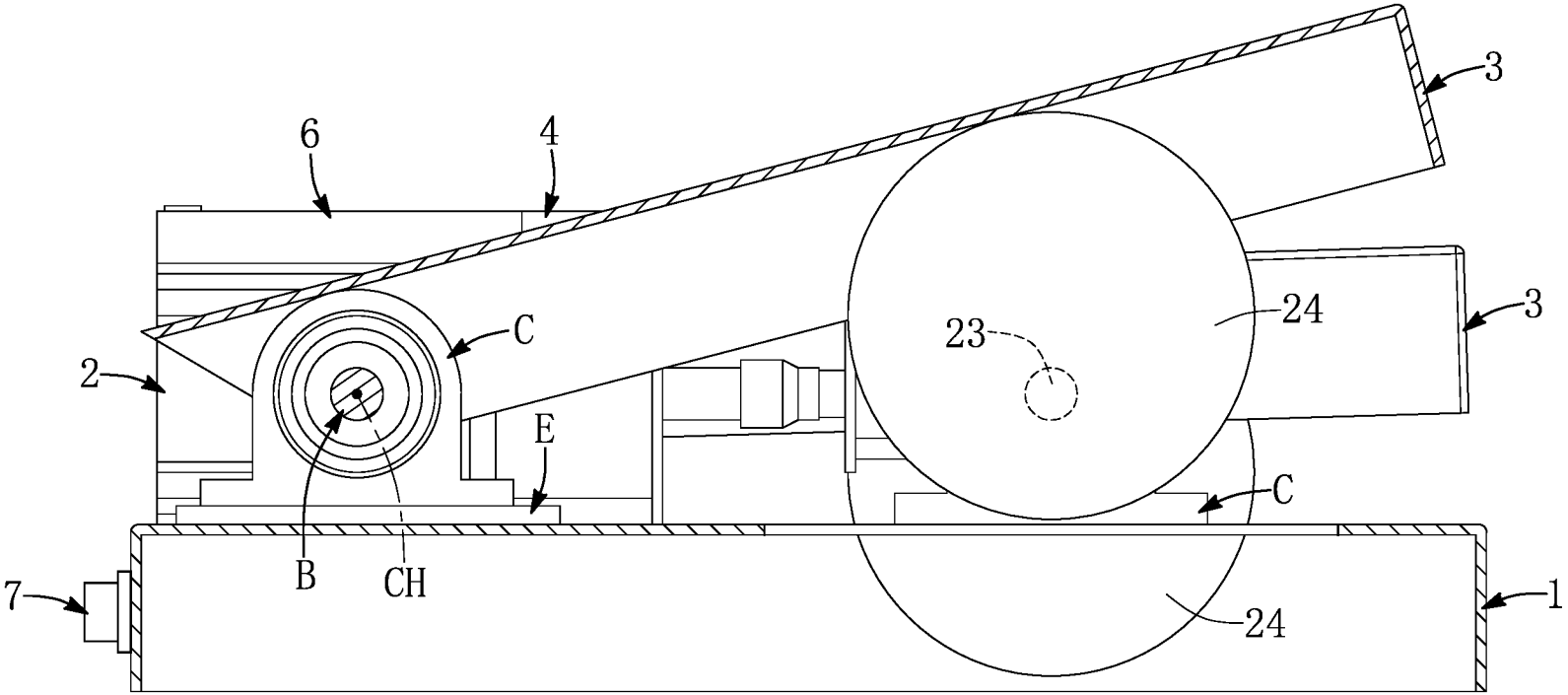
FIG. 6 is a schematic partial cross-sectional view of the training device according to another embodiment of the present disclosure.

In another one of the embodiments (as shown in FIG. 6), each of the two pedals 3 can be coupled to a position adjustment mechanism E that can be disposed on the base 1. The position adjustment mechanism E can correspondingly adjust a height of one end of each of the two pedals 3 relative to the base 1 according to a control signal transmitted from the control circuit 4 or can correspondingly adjust a distance of the rotation axis A relative to the base 1 according to a control signal transmitted from the control circuit 4 so as to change the first angle θ1 and the second angle θ2. It should be noted that any similar mechanism that can change the first angle θ1 and the second angle θ2 according to the control signal of the control circuit 4 should be considered as being within a range of application of the position adjustment mechanism E.

In practical applications, the control circuit 4 can store only a training program or a plurality of training programs, and the present disclosure is not limited thereto. In practical applications, each of the training programs includes at least one training control parameter. For example, the at least one training control parameter can include a swing speed of each of the two pedals 3, the first angle θ1, the second angle θ2, and a swinging amplitude of each of the two pedals 3. In an embodiment that the control circuit 4 stores multiple training programs, when the control circuit 4 executes different training programs, at least one of the swing speeds of the two pedals 3 (i.e., the number of swings per minute), the swinging amplitudes of the two pedals 3, and the first angle θ1 of each of the two pedals 3 may not be completely the same, but the present disclosure is not limited thereto.

In practical applications, the training program can have a plurality of training time segments, and time ratios of each of the training time segments to a duration of the training program are not the same in one training program. In the different training time segments, the number of swings, swing speed and swing angle of the two pedals 3 may be different from each other. For example, three of the training time segments (e.g., five minutes, twenty minutes, and five minutes) can be included in one training program, and the control circuit 4 can control each of the two pedals 3 to swing 15 times per minute in five minutes before executing the training program. Then, in the next twenty minutes, the control circuit 4 can control each of the two pedals 3 to swing 30 times per minute. In the last five minutes, the control circuit 4 can control each of the two pedals 3 to swing 15 times per minute. In practical applications, the rotation speed of the motor 21 and the number of swings per minute of each of the two pedals 3 can be positively correlated. Preferably, the control circuit 4 can control the number of swings per minute of each of the two pedals 3 so as to be within a range from a cadence for slow walking to a cadence for sprinting.

It should be noted that in practical applications, the relevant personnel can execute the training program by control circuit 4 according to requirements so as to make the two pedals 3 swing in different directions. That is, when one of the two pedals 3 swings in a direction that is toward base 1, the other one of the two pedals 3 will swing in a direction that is away from base 1. Or, the two pedals 3 can also swing synchronously, that is, the two pedals 3 simultaneously swing in a direction that is toward base 1 or simultaneously swing in a direction that is away from base 1. Or, the control circuit 4 can make the two pedals 3 swing in the same direction with different swinging amplitudes. For example, when one of the two pedals 3 swings one degree toward base 1, the other one of the two pedals 3 will swing three degrees toward base 1.

Specifically, each of the two linkage wheels 24 may be a cam (i.e., a member having an outer contour in an oval shape), and includes a plurality of locking holes (e.g., the quantity of the locking holes is two, four, six, or eight, etc.) arranged approximately around the center of the cam. The relevant assembler can make one end of one of the two connecting rods 23 and one end of the other one of the two connecting rods 23 coupled to one of the locking holes of one of the cams and one of the locking holes of another one of the cams that do not correspond in position to each other. In this way, when the two connecting rods 23 are driven synchronously, the two pedals 3 will abut against two corresponding ones of the cams at different positions, respectively. Accordingly, the two pedals 3 can achieve a swing effect with phase difference.

In another one of embodiments, each of the two linkage wheels 24 may have a polygonal hole that is eccentrically formed in a corresponding one of the two linkage wheels 24. One end of each of the two connecting rods 23 may have a corresponding polygonal structure configured to engage with the polygonal hole of one of the two linkage wheels 24. Therefore, the relevant personnel can adjust a position where one of the polygonal holes of the two linkage wheels 24 and one of the polygonal structures of the two connecting rods 23 are engaged with each other according to requirements, so that the two pedals 3 can swing with phase difference.

For example, the two linkage wheels 24 can have exactly the same structure, and each of the polygonal structures may be a rectangular groove. When the relevant personnel are assembling the two linkage wheels 24, the relevant personnel can make two of the polygonal structures located close to the base 1 or away from base 1. Therefore, the two pedals 3 will swing without phase difference. Relatively, when the polygonal hole of one of the two linkage wheels 24 is arranged adjacent to the base 1 and the polygonal hole of another one of the two linkage wheels 24 is arranged away from base 1, the two pedals 3 will swing with a phase difference of 180 degrees.

Therefore, in different embodiments, the relevant personnel can make the two pedals 3 swung at different phase angles by changing the shapes of the polygonal holes and the polygonal structures of each of the two connecting rods 23, so that the two pedals 3 can swing in different phase angles. For example, when each of the polygonal holes is in a square shape, the phase difference between the two pedals 3 can be adjusted by the relevant personnel to be 0 degrees, 90 degrees, 180 degrees, or 270 degrees according to requirements. When each of the polygonal holes is in a hexagonal shape, the relevant personnel can make the phase difference between the two pedals 3 being 0 degrees, 60 degrees, 120 degrees, 180 degrees, 240 degrees, or 300 degrees according to requirements. That is, an operating mode of the training device had a same-phase swing mode and a different-phase swing mode.

In one of the practical applications, the control circuit 4 may include a processor 41, a storage unit 42, and a communication unit 43, each of the storage unit 42 and the communication unit 43 are electrically coupled to the processor 41, and the processor 41 can receive the at least one training program transmitted from an external electronic device D (e.g., a smartphone, and a tablet, etc.) in a wired or wireless manner through the communication unit 43. For example, the user can generate the at least one training program through an application in the external electronic device D and transmits the at least one training program to the control circuit 4.

Specifically, when the relevant personnel execute the application through the external electronic device D, the relevant personnel can view the training programs currently stored in the control circuit 4 on a display screen of the external electronic device D. The relevant personnel can click on one of the training programs displayed on the external electronic device D according to the patient's condition so as to control the control circuit 4 to execute a corresponding training programs.

The training device 100 may also include an operating interface 6 electrically coupled to the processor 41, and the operating interface 6 is used to provide user operation to control the processor 41 to execute one of the training programs in the storage unit 42. That is to say, the relevant personnel can make the control circuit 4 execute one of the training programs that is suitable for the patient's training through the operating interface 6 according to the patient's condition. For example, the operating interface 6 may include a display panel 61 and a plurality of buttons 62, and the display panel 61 shows the swing angle and the number of swings of each of the two pedals 3. The control circuit 4 can set a value corresponding to the training programs according to the state of the buttons 62 being pressed. Naturally, in different embodiments, the control circuit 4 may also include a wireless communication circuit, and the control circuit 4 can be coupled to an external electronic device (e.g., a server, a smartphone, a tablet, etc.) through the wireless communication circuit, so that the related personnel can control the control circuit 4 through the external electronic device.

In addition, in a preferred application, after the control circuit 4 has executed the training programs, the processor 41 can correspondingly generate a recorded information stored in the storage unit 42. The recorded information may include, for example, a plurality of parameters of the training programs (e.g., a motor speed in the training cycle, the number of swings of each of the two pedals 3 in the training cycle, a training time) and a training date. Moreover, the processor 41 can transmit the recorded information to the external electronic device D or a cloud server through communication unit 43, and the relevant personnel can read the recorded information about the patient on the external electronic device D and the cloud server so as to track the patient's exercise status.

The control circuit 4 may also include a switch circuit 5 (e.g., a button 51) that can be used to turn on or turn off the training device 100 for reducing hypertonic. The control circuit 4 can also include a shutdown circuit 7. Specifically, the shutdown circuit 7 may include a button, and when the patient experiences any discomfort or emergency situations while using the training device 100, the patient can quickly stop the training device 100 by pressing the shutdown circuit 7.

Figure 7:
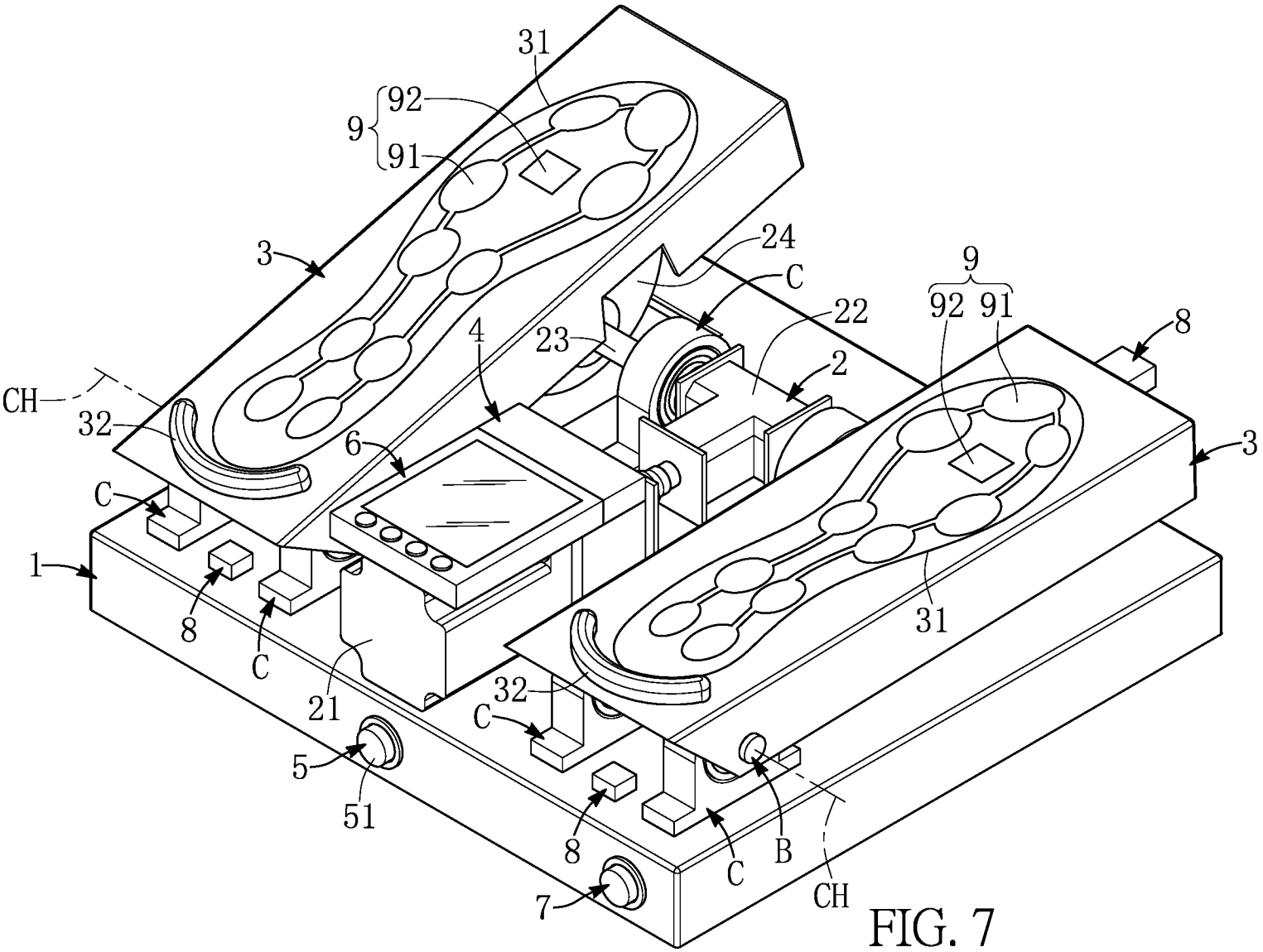
FIG. 7 is a schematic partial cross-sectional view of the training device according to yet another embodiment of the present disclosure.

Referring to FIG. 7, each of the two pedals 3 in the present embodiment also includes a limiting structure 32 that is configured to limit the range of activity of one of the soles of the feet disposed in the placement area 31 corresponding to the pedal 3. In the present embodiment, when one the soles of the user's feet is set in the placement area 31, the limiting structure 32 abuts the corresponding heel of the user, but the shape and position of the limiting structure 32 are not limited thereto.

In one of the embodiments, the motor 21 may, for example, be a stepping motor. The control circuit 4 can obtain a rotation angle of each of the two pedals 3 relative to the base 1 while controlling the stepping motor. In another one of the embodiments, the training device 100 may also include two angle detection circuits 8, and each of the two angle detection circuits 8 is used to detect the rotation angle of each of the two pedals 3 relative to the base 1. The two angle detection circuits 8 are electrically coupled to control circuit 4. The control circuit 4 is configured to correspondingly control the swing angle of each of the two pedals 3 from the first position to the second position according to a detection result transmitted by each of the two angle detection circuits 8. The relevant personnel can more accurately understand the rotation angle of each of the two pedals 3 relative to the base 1 by virtue of the two angle detection circuits 8 so as to better grasp the training effects on the patient. In yet another one of the embodiments, the control circuit 4 can transmit information generated by each of the two angle detection circuits 8 to the external electronic device D. The relevant personnel can calibrate the driving circuit 2 by operating the external electronic device D, so that the driving circuit 2 can rotate each of the two pedals 3 to a predetermined angle more accurately. In different embodiments, the control circuit 4 may also be a display included in the operating interface 6, and displays the information generated by each of the two angle detection circuits 8. The user can calibrate the driving circuit 2 by operating the operating interface 6. Naturally, the control circuit 4 can also automatically calibrate the action of the driving circuit 2 according to a result detected by each of the two angle detection circuits 8.

The training device 100 in the present embodiment may also include two sensing circuits 9, and each of the two sensing circuits 9 includes a plurality of pressure sensors 91. The pressure sensors 91 of each of the two sensing circuits 9 are disposed on one of the two pedals 3 and correspond in position to the placement area 31. The control circuit 4 is electrically coupled to each of the pressure sensors 91, and the processor 41 of the control circuit 4 can obtain a resistance-angle control data set corresponding to the user's calf muscles through the pressure values that are returned by the pressure sensors 91 and the angle of each of two pedals 3 (i.e., an angle between the plane in the placement area 31 and the horizontal plane).

The resistance-angle control data set shows the pressure values sensed by the pressure sensors 91 when the two pedals 3 are at different angles (such a test being referred to as "muscle tension test" in the present disclosure). The processor 41 may control the display panel 61 to display a resistance-angle curve according to the resistance-angle control data set, or transmit the resistance-angle control data set to the external electronic device D. After the external electronic device D receives the resistance-angle control data set transmitted by the processor 41, the external electronic device D display the corresponding resistance-angle curve. The pressure values reflect the resistance of the calf muscles.

Further, the motor 21 may be a stepping motor, when the control circuit 4 controls the motor 21 to rotate a predetermined angle (i.e., an angular variation between the plane in the placement area 31 of one of the two pedals 3 and the horizontal plane), the control circuit 4 instantly obtain a current pressure value measured by each of the pressure sensors 91. The current pressure value is subtracted from a pressure value measured at the time the feet are placed on the two pedals 3 (e.g., the pressure value before swinging, or the pressure value of the initial angle) in a stationary state to obtain a resistance value. Accordingly, the control circuit 4 calculates the resistance-angle curve.

Based on the above, the maximum resistance value in the resistance-angle curve can be used to judge the hypertonic of the user's calf muscles. The greater the maximum resistance value is, the higher the tension of the calf muscles of the user (i.e., the muscles of the user are in a state of rigidity or spasticity). Conversely, the user's calf muscles are taken as not having hypertonic problems.

Generally, when the muscles are in the state of rigidity or spasticity, there usually is the problem of muscle hypertonic. The training device 100 of the present disclosure can be used to test the muscle tension of the user's calf muscles so as to distinguish whether the user's calf muscles have muscle rigidity or spasticity.

In one of the embodiments, the control circuit 4 performs hypertonic analysis test to determine whether the user's calf muscles have muscle rigidity or spasticity. Specifically, when the control circuit 4 performs the hypertonic analysis test, the control circuit 4 controls the two pedals 3 to swing at a first speed and obtain a first resistance-angle data set. Then, the control circuit 4 controls the two pedals 3 to swing at a second speed and obtain a second resistance-angle data set. After that, the control circuit 4 finds the maximum resistance value in the first resistance-angle data set and divides the maximum resistance value in the first resistance-angle data set by the maximum resistance value in the second resistance-angle data set to get a comparison value. The first speed is not the same as the second speed, and the first speed can be greater than the second speed.

For example, when the two pedals 3 swing at the first speed, the two pedals 3 can swing 60 times per minute; when the two pedals 3 swing at the second speed, the two pedals 3 can swing 30 times per minute. When the comparison value is close to 1, it indicates that the user's calf muscles may have muscle rigidity. On the contrary, the greater a difference between the comparison value and 1 is, the more likely the user's calf muscles may have muscle spasticity.

The greater the comparison value is, the larger the role of muscle reflex spasticity plays in the presentation of the hypertonic.

As mentioned above, the control circuit 4 determines whether the user's calf muscles sustain hypertonic problems through "the muscle tension test" (that is, the maximum resistance value is greater, the severity of the hypertonic is greater). If the control circuit 4 determines that the user's calf muscles sustains hypertonic, the control circuit 4 will perform "the hypertonic analysis test" again, to determine the severity of muscle rigidity or spasticity of the user's calf muscles.

Moreover, in a preferred embodiment, the process to determine whether the user's calf muscles sustain hypertonic, the control circuit 4 undergoes a process that when the maximum resistance value in the resistance-angle control data set exceeds a hypertonic threshold value to then it is judged that the user's calf muscles sustain a hypertonic problem. Similarly, the control circuit 4 determines whether the calf muscle of the user sustains rigidity or spasticity problems through the process of judging if the calculated comparison value exceeds a predetermined threshold value. When the control circuit 4 detects that the calculated comparison value exceeds the predetermined threshold value, spasticity of the user's calf muscle is determined. When the control circuit 4 detects that the comparison value does not exceed the predetermined threshold value, the control circuit 4 determines that the user's calf muscles have muscle rigidity. The hypertonic threshold value and the predetermined threshold value may be obtained through statistics of a large amount of experimental data. The present embodiment is not limited thereto. The predetermined threshold value may be different according to subject groups (e.g., average person, athlete, young people, or senior citizen, etc.), and the training device 100 of the present disclosure can adjust the predetermined threshold value according to different users.

In addition, the processor 41 of the control circuit 4 can perform plural rounds of measurement to obtain a plurality of rounds of resistance-angle data sets for a rotation speed of the motor 21 under fast (e.g., 60 rotations per minute) or slow (e.g., 20 rotations per minute) speed, so as to obtain a first resistance drop range in the first round and the last round (e.g., the Nth round) during the rotation speed of the motor 21 that is fast, and a second resistance drop range in the first round and the last round (e.g., the Nth round) during the rotation speed of the motor 21 that is slow. Accordingly, the processor 41 can obtain an index that represent a degree of post activation depression (PAD) according to the first resistance drop range and the second resistance drop range.

Specifically, the processor 41 may control the motor 21 to rotate at a relatively slow speed, so that each of the two pedals swings for a predetermined number of times. Then, for every swing of each of the two pedals 3, the processor 41 obtains the corresponding pressure value through the pressure sensors 91. After that, for every swing of each of the two pedals 3, the processor 41 will obtain a corresponding resistance-angle data set. Afterwards, the processor 41 can find the maximum resistance value $R_{MAX_S1}$ in the resistance-angle data sets corresponding to the first swing of each of the two pedals 3 (i.e., the first round) and the maximum resistance value $R_{MAX_SN}$ in the resistance-angle data sets corresponding to the last swing of each of the two pedals 3 (i.e., the Nth round).

Then, the processor 41 can control the motor 21 to rotate at a relatively fast speed, so that each of the two pedals 3 swings a predetermined number of times. For every swing of each of the two pedals 3, the processor 41 obtains the corresponding pressure value through the pressure sensors 91. For every swing of each of the two pedals 3, the processor 41 will obtain a corresponding resistance-angle data set. After that, the processor 41 can find the maximum resistance value $R_{MAX_F1}$ in the resistance-angle data sets corresponding to the first swing of each of the two pedals 3 (i.e., the first round) and the maximum resistance value $R_{MAX_FN}$ in the resistance-angle data sets corresponding to the last swing of each of the two pedals 3 (i.e., the Nth round). Finally, the processor 41 calculates the index of the degree of post-activation inhibition (PAD) through the following mathematical relation:

$$\frac{R_{MAX_FN} - R_{MAX_F1}}{R_{MAX_SN} - R_{MAX_S1}}.$$

In practical applications, the pressure sensors 91 may be disposed at the front end and the rear end of each of the two pedals 3. The pressure value measured by the pressure sensors 91 at the rear end of each of the two pedals 3 can be used to indicate a resistance of a knee joint, and a pressure value measured by the pressure sensors 91 at the front end of each of the two pedals 3 can be used to indicate the resistance of an ankle joint. The processor 41 of the control circuit 4 can adjust the angle of the two pedals 3 according to the pressure values measured by the pressure sensors 91 at the front end and the rear end.

In one preferred embodiment, when the pressure values returned by the pressure sensors 91 of each of the two pedals 3 are too small (that is, the pressure values are less than a critical value, for example, 0.95 times the pressure value before swing or the pressure value of the initial angle), the processor 41 of the control circuit 4 can determine that the soles of the user's feet may not be placed correctly on the two pedals (e.g., any one of the soles of the feet have left the two pedals). At this, the control circuit 4 will drive a warning device to remind the user that the feet soles thereon were not placed correctly, so as to achieve the effect of foolproof. The warning device may be a horn, or a light-emitting unit, etc. When the warning device is driven by the control circuit 4, the warning device can produce a specific sound or a specific light beam.

In different embodiments, the processor 41 of the control circuit 4 can decide whether to adjust a training parameter in the next round according to the pressure values returned by the pressure sensors 91 in the current round. For example, when the processor 41 of the control circuit 4 detects that the resistance in the current round is too large (that is, the pressure values sensed by the pressure sensors 91 are relatively large), the processor 41 of the control circuit 4 will reduce (or stop) the motor speed of the next round and/or reduce the swinging amplitude of the two pedals 3. Another example, when the processor 41 of the control circuit 4 detects that the resistance in the current round is too large or too small, the processor 41 of the control circuit 4 will adaptively adjust the motor speed and/or the swinging amplitude of the two pedals 3 in the next round.

In one of the embodiments, before training programs execution, the control circuit 4 may measure and record the degree of hypertension of the user's feet. After the control circuit 4 executes the training programs, the control circuit 4 can also record the degree of hypertension of the feet (that is, the PAD calculated) thereby to determine whether the user's feet restore normal tension by comparing the degree of hypertonicity of the user's feet. For example, a patient experiencing stroke may not be able to move one side of his/her body (e.g., a left leg or a right leg) normally, the control circuit 4 compares the degree of hypertonicity of the feet, which can be used further as one of the indicators to monitor the treatment effect. The control circuit 4 controls the two pedals 3 to swing at a predetermined swing speed to detect the degree of high tension in the user's feet. In the process, the control circuit 4 obtains the real time corresponding pressure value through the pressure sensors and calculates the PAD of the user's calf before training.

In another embodiment, to monitor increase in blood oxygen consumption in the calf muscles, one of the two sensing circuits 9 includes a blood oxygen detector 92 correspondingly disposed on one of the pedals 3, are used to detect a blood oxygen value (e.g., pulse oxygen saturation (SpO2)) of one of the user's foot (e.g., sole or toe)) disposed on one of the pedals 3. The control circuit 4 applies the detection result (e.g., pulse oxygen saturation (SpO2)) detected by the blood oxygen detector 92 as one of the indicators to monitor the state of the calf muscles of the patient. For example, the processor 41 of the control circuit 4 can analyze associations between of the blood oxygen value and at least one of indicators (degree of hypertonic, rigidity or spasticity, post-activation inhibition (PAD)) according to the blood oxygen value and the resistance-angle data set. For example, the changes of each indicator (degree of hypertonic, rigidity or spasticity, post-activation inhibition (PAD)) under aerobic training and anaerobic training can be obtained separately.

Figure 8:
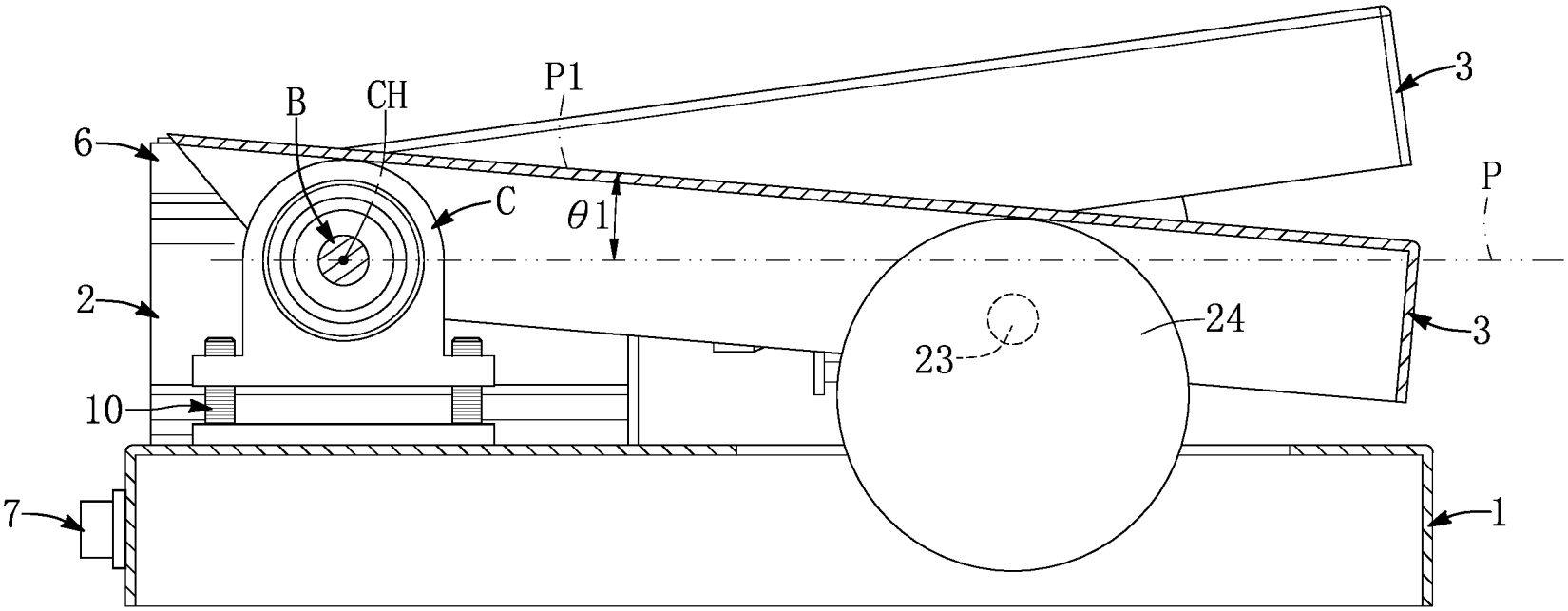
FIG. 8 and FIG. 9 are schematic partial cross-sectional views of the two pedals of the training device located in the first position and the second position, respectively, according to still yet another embodiment of the present disclosure.
Figure 9:
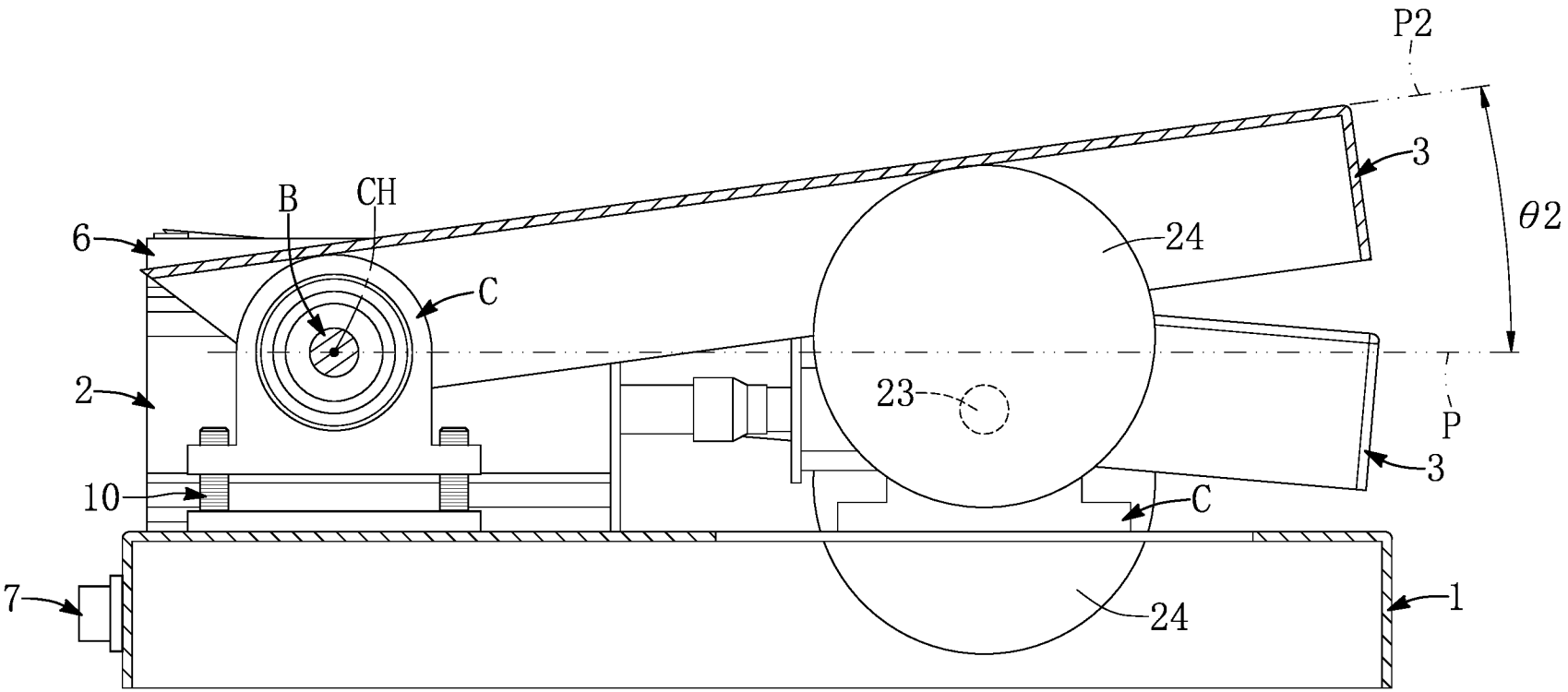

Referring to FIG. 8 and FIG. 9, the difference between the present embodiment and the foregoing embodiment mainly resides in that the driving circuit 2 may also include a lifting mechanism 10 disposed on the base 1. The two pedals 3 are pivotally coupled to the lifting mechanism 10, and the processor 41 is electrically coupled to the lifting mechanism 10. The user can control the lifting mechanism 10 to move the two pedals 3 in a direction that is away from the base 1 or toward the base 1 by operating the operation interface 6.

When the user controls the lifting mechanism 10 to move the two pedals 3 away from the base 1 and each of the two pedals 3 is in the first position, the first angle θ1 between plane P1 in the placement area 31 of each of the two pedals 3 and the horizontal plane P forms a negative degree. When each of the two pedals 3 is in the second position, the second angle θ2 between plane P2 in the placement area 31 of each of the two pedals 3 and the horizontal plane P forms a positive degree.

It has been found that a continuous and small-ranged passive movement training of the ankle joints significantly reduce spasticity, simultaneously restores the post activation depression of Hoffmann reflex, and significantly revives the regulation of the spinal cord circuit (post activation depression). The muscle fibers will also recover (fast twitch muscle fibers transform into slow twitch muscle fibers) under continuous movement training. Therefore, using training device 100, muscle hypertonicity of patients with spasticity can be effectively reduced, and the occurrence of spasticity can also be reduced.

BENEFICIAL EFFECTS OF THE EMBODIMENTS

In conclusion, the training device of the present disclosure has a manner of operation that is simple enough for the patient to operate on their own, and essentially does not cause any side effects on the patient's body.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A training device, comprising:

a base;

a driving circuit fixed on the base;

two pedals, wherein each of the two pedals is coupled to the base, and one of two ends of each of the two pedals is configured to swing relative to the base with a rotation axis as a center; wherein each of the two pedals has a placement area configured to allow feet soles of a user to be placed thereon; wherein the two pedals are coupled to the driving circuit that is configured to drive each of the two pedals to swing repeatedly between a first position and a second position relative to the base;

a control circuit electrically coupled to the driving circuit; wherein the control circuit is configured to store and execute at least one training program; wherein the control circuit actuates the driving circuit according to at least one training program, so that the two pedals are driven to swing; wherein the at least one training program comprises a number of swings, and a swing speed; and two pressure sensors coupled to the control circuit and respectively disposed on the placement area of the two pedals; wherein the control circuit is configured to output a resistance-angle curve according to a pressure value transmitted by the pressure sensors in a corresponding swing angle of the pedal;

wherein the control circuit is configured to control the pedals to swing many times at a first swing speed and a second swing speed to obtain a plurality of first resistance-angle data sets and a plurality of second resistance-angle data sets; wherein the control circuit is configured to obtain an index of a post activation depression according to the plurality of first resistance-angle data sets and the plurality of second resistance-angle data sets; and wherein the first swing speed and the second swing speed are different.

2. The training device of claim 1, wherein the driving circuit includes a motor, an adapter mechanism, two connecting rods, and two linkage wheels; wherein the motor is coupled to the adapter mechanism, the two connecting rods are coupled to the adapter mechanism, and each of the two linkage wheels abuts against one of the two pedals; wherein the control circuit is configured to control the motor to actuate and the two connecting rods are driven to rotate, through the adapter mechanism, by rotation of the motor, so as to drive synchronous rotation of the two linkage wheels; wherein each of the two linkage wheels that are in rotation is configured to drive one of the two pedals abutting thereagainst.

3. The training device of claim 1, wherein the control circuit includes a processor, and a storage unit; wherein the processor is coupled to the storage unit, and the processor is configured to receive the at least one training program transmitted from an external electronic device; wherein the at least one training program comprises a motor speed of the motor in a training cycle and the number of swings of each of the two pedals in the training cycle.

4. The training device of claim 1, wherein an operating mode of the training device comprises a same-phase swing mode and a different-phase swing mode.

5. The training device of claim 1, wherein the control circuit stores a plurality of training programs; wherein each of the plurality of training programs comprises a corresponding swing speed, a corresponding swing amplitude, and a corresponding initial angle of the two pedals.

6. The training device of claim 1, wherein the at least one training program includes a plurality of training time segments, and time proportions of the plurality of the training time segments in the at least one training program are not the same.

7. The training device of claim 1, wherein the at least one training program includes a plurality of training time segments, wherein, in the plurality of the training time segments, the number of swings and the swing speed of the two pedals are not the same.

8. The training device of claim 1, further comprising an angle detection circuit; wherein the angle detection circuit is configured to detect a rotation angle of one of the two pedals relative to the base; wherein the angle detection circuit is coupled to the control circuit.

9. The training device of claim 1, wherein the control circuit is configured to drive a warning device when the pressure values transmitted by the pressure sensors are less than a threshold value.

10. The training device of claim 1, wherein the control circuit is configured to control the pedals to swing at the swing speed to obtain a resistance-angle data set comprising calculated resistance values at different angles; wherein the control circuit is configured to determine whether calf muscles of the user are in a hypertonic state according to the resistance-angle data set.

11. The training device of claim 1, wherein the control circuit is configured to control the pedals to swing at a first swing speed and a second swing speed, to obtain a first resistance-angle data set and a second resistance-angle data set; wherein the control circuit is configured to determine whether calf muscles of the user are in a spasticity state or a rigidity state according to the first and the second resistance-angle data sets; wherein the first swing speed and the second swing speed are different.

12. A training device, comprising:

a base;

a driving circuit fixed on the base;

two pedals, wherein each of the two pedals is coupled to the base, and one of two ends of each of the two pedals is configured to swing relative to the base with a rotation axis as a center; wherein each of the two pedals has a placement area configured to allow feet soles of a user to be placed thereon; wherein the two pedals are coupled to the driving circuit that is configured to drive each of the two pedals to swing repeatedly between a first position and a second position relative to the base;

a control circuit electrically coupled to the driving circuit wherein the control circuit is configured to store and execute at least one training program; wherein the control circuit actuates the driving circuit according to at least one training program, so that the two pedals are driven to swing; wherein the at least one training program comprises a number of swings, and a swing speed;

two pressure sensors coupled to the control circuit and respectively disposed on the placement area of the two pedals; wherein the control circuit is configured to output a resistance-angle curve according to a pressure value transmitted by the pressure sensors in a corresponding swing angle of the pedal; and a blood oxygen detector coupled to the control circuit;

wherein the control circuit is configured to receive blood oxygen data from the blood oxygen detector, control the pedals to swing at the swing speed to obtain a resistance-angle data set comprising calculated resistance values at different angles, and analyze an association between the resistance-angle data set and the blood oxygen data.

13. A training method for using a training device that comprises a control circuit, a driving circuit, two pedals, and two pressure sensors, the pressure sensors coupled to the control circuit and respectively disposed on a placement area of the two pedals, the training method comprising:

receiving at least one training program by the control circuit;

performing the at least one training program by the control circuit, so as to control the driving circuit to actuate the two pedals that are driven to swing;

wherein the at least one training program comprises a number of swings and a swing speed;

generating a plurality of first resistance-angle data sets according to a plurality of first pressure values transmitted by the pressure sensor in a corresponding swing angle of the pedal in a first swing speed, generating a plurality of second resistance-angle data sets according to a plurality of second pressure values transmitted by the pressure sensor in a corresponding swing angle of the pedal in a second swing speed that is different form the first swing speed; and obtaining an index of a degree of a post activation depression according to the plurality of the first resistance-angle data sets and the plurality of the second resistance-angle data sets.

14. The training method of claim 13, further comprising;

determining whether calf muscles of a user are in a hypertonic state according to the first resistance-angle data set.

15. The training method of claim 13, further comprising:

determining whether calf muscles of the user are in a spasticity state or a rigidity state according to the first resistance-angle data set and the second resistance-angle data set.

16. The training method of claim 13, wherein the training device comprises an adjustable mechanism disposed on a base of the training device, and the two pedals are pivotally coupled to the adjustable mechanism, the training method further comprising:

adjusting an initial angle of the two pedals by controlling a relative position between the adjustable mechanism and the base.

* * * * *